US011326231B2

(12) United States Patent
Suzuki et al.

(10) Patent No.: US 11,326,231 B2
(45) Date of Patent: May 10, 2022

(54) NI-BASED ALLOY FOR HOT-WORKING DIE, AND HOT-FORGING DIE USING SAME

(71) Applicant: HITACHI METALS, LTD., Tokyo (JP)

(72) Inventors: Shogo Suzuki, Tokyo (JP); Tomonori Ueno, Tokyo (JP); Chuya Aoki, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 142 days.

(21) Appl. No.: 16/767,455

(22) PCT Filed: Sep. 21, 2018

(86) PCT No.: PCT/JP2018/035219
§ 371 (c)(1),
(2) Date: May 27, 2020

(87) PCT Pub. No.: WO2019/106922
PCT Pub. Date: Jun. 6, 2019

(65) Prior Publication Data

US 2020/0370148 A1 Nov. 26, 2020

(30) Foreign Application Priority Data

Nov. 29, 2017 (JP) ..... JP2017-228955

(51) Int. Cl.
*C22C 19/05* (2006.01)
*B21J 13/02* (2006.01)

(52) U.S. Cl.
CPC ..... *C22C 19/057* (2013.01); *B21J 13/02* (2013.01)

(58) Field of Classification Search
CPC ..... C22C 19/057; C22F 1/10
See application file for complete search history.

(56) References Cited

U.S. PATENT DOCUMENTS

| | | | |
|---|---|---|---|
| 3,973,952 | A | 8/1976 | Bieber et al. |
| 4,740,354 | A | 4/1988 | Watanabe et al. |
| 4,802,934 | A | 2/1989 | Ohno et al. |
| 2005/0092398 | A1 | 5/2005 | Kobayashi et al. |
| 2007/0199628 | A1 | 8/2007 | Nazmy |
| 2011/0076181 | A1 | 3/2011 | Suzuki et al. |
| 2015/0284823 | A1 | 10/2015 | Osaki et al. |
| 2018/0290202 | A1 | 10/2018 | Suzuki et al. |

FOREIGN PATENT DOCUMENTS

| | | | | |
|---|---|---|---|---|
| CA | 1198612 | A | 12/1985 | |
| CN | 1718803 | A | 1/2006 | |
| CN | 101061244 | A | 10/2007 | |
| CN | 104278175 | A | 1/2015 | |
| CN | 105714153 | A | 6/2016 | |
| CN | 107190158 | A | 9/2017 | |
| CN | 107217227 | A | 9/2017 | |
| CN | 110337335 | A | 10/2019 | |
| EP | 0460678 | A1 | 12/1991 | |
| EP | 1930455 | A1 * | 6/2008 | ..... C22C 1/0433 |
| GB | 2110240 | A | 6/1983 | |
| JP | 50-16613 | A | 2/1975 | |
| JP | 60-221542 | A | 11/1985 | |
| JP | 62-50429 | A | 3/1987 | |
| JP | 62-116748 | A | 5/1987 | |
| JP | 2016-69702 | A | 5/2016 | |
| JP | 2016-69703 | A | 5/2016 | |
| JP | 2017064741 | A | 4/2017 | |
| JP | 6566255 | B2 | 8/2019 | |
| RU | 2386714 | C1 | 4/2010 | |
| WO | 03080882 | A1 | 10/2003 | |
| WO | 2014126086 | A1 | 8/2014 | |
| WO | 2017/057453 | A1 | 4/2017 | |
| WO | 2017/204286 | A1 | 11/2017 | |
| WO | 2018/117226 | A1 | 6/2018 | |
| WO | 2019/107502 | A1 | 6/2019 | |

OTHER PUBLICATIONS

Chinese Office Action corresponding to CN 201880077059.7; dated Jun. 25, 2021 (15 pages, including English translation).
"Communication with Supplementary European Search Report", EP Application No. 18882641.6, dated Mar. 3, 2021, 7 pp.
"Communication with Supplementary European Search Report", EP Application No. 18883639.9, dated Mar. 4, 2021, 7 pp.
"First Office Action and English language translation", CN Application No. 201880077444.1, dated Apr. 6, 2021, 13 pp.
Bao, Qinghuang , et al., "Research Progress on the Corrosion Resistance of Nickel-based Superalloy", China Academic Journal Electronic Publishing House, DOI: 10.11896/j. issn. 1005-023X. 2015.017.024, Sep. 10, 2015, pp. 128-134.
Farag, Mahmoud M., et al., "Behavior of a Nickel-Base High-Temperature Alloy Under Hot-Working Conditions", Metallurgical Transactions A, vol. 7A, Feb. 1976, pp. 221-228.
Zhang, Jian , et al., "Recent Progress in Research and Development of Nickel-Based Single Crystal Superalloys", ACTA Metallurgica Sinica, vol. 55, No. 9, Sep. 2019, pp. 1077-1094.
International Search Report, International Application No. PCT/JP2018/035219, dated Dec. 18, 2018, 1 p.
(Continued)

*Primary Examiner* — Jessee R Roe
(74) *Attorney, Agent, or Firm* — Myers Bigel, P.A.

(57) ABSTRACT

Provided are a Ni-based alloy for hot die having a high high-temperature compressive strength and a good oxidation resistance and being capable of suppressing the deterioration in the working environment and the shape deterioration, and a hot forging die made of the Ni-based alloy for hot die. The Ni-based alloy for hot die comprises, in mass %, W: 7.0 to 15.0%, Mo: 2.5 to 11.0%, Al: 5.0 to 7.5%, Cr: 0.5 to 3.0%, Ta: 0.5 to 7.0%, S: 0.0010% or less, one or two or more selected from rare-earth elements, Y, and Mg in a total amount of 0 to 0.020%, and the balance of Ni with inevitable impurities. In addition to the composition described above, one or two elements selected from Zr and Hf can further be contained in a total amount of 0.5% or less.

7 Claims, 2 Drawing Sheets

(56) References Cited

OTHER PUBLICATIONS

Notice of Reasons for Refusal and English language translation, JP Application No. 2019-530837, dated Aug. 20, 2019, 9 pp.
International Search Report, International Application No. PCT/JP2018/044012, dated Mar. 5, 2019, 2 pp.
Notice of Reasons for Refusal and English language translation, JP Application No. 2019-530836, dated Aug. 21, 2019, 13 pp.

* cited by examiner (a)

(b)

NI-BASED ALLOY FOR HOT-WORKING DIE, AND HOT-FORGING DIE USING SAME

RELATED APPLICATIONS

This application is a 35 U.S.C. § 371 national stage application of PCT Application No. PCT/JP2018/035219, filed on Sep. 21, 2018, which claims priority from Japanese Patent Application No. 2017-228955, filed on Nov. 29, 2017, the contents of which are incorporated herein by reference in their entireties. The above-referenced PCT International Application was published in the Japanese language as International Publication No. WO 2019/106922 A1 on Jun. 6, 2019.

TECHNICAL FIELD

The present invention relates to a Ni-based alloy for a hot die and a hot forging die made thereof.

BACKGROUND ART

In the forging of a product made of heat-resistant alloy, a material for forging is heated to a predetermined temperature to reduce the deformation resistance. The heat-resistant alloy has a high strength even at a high temperature, and a hot forging die to be used in the forging is required to have high mechanical strength at a high temperature. When the temperature of a hot forging die is lower than the temperature of a material for forging in hot forging, the workability of the material for forging decreases due to heat removal, and thus, products of poor workability materials such as Alloy 718 and Ti alloy are forged by heating the hot forging die with the raw material. Consequently, the hot forging die should have a high mechanical strength at a high temperature equal to or near the temperature to which the material for forging is heated. As a hot forging die that satisfies this requirement, Ni-based heat-resistant super alloys that can be used in hot forging at a die temperature of 1000° C. or more in the air are proposed (for example, See Patent Documents 1 to 5).

As used herein, the term hot forging includes hot die forging in which the temperature of the hot forging die is close to the temperature of the material for forging and isothermal forging in which the hot forging die is heated to the same temperature as the material for forging.

REFERENCE DOCUMENT LIST

Patent Documents

Patent Document 1: JP 62-50429 A
Patent Document 2: JP 60-221542 A
Patent Document 3: JP 2016-069702 A
Patent Document 4: JP 2016-069703 A
Patent Document 5: U.S. Pat. No. 4,740,354 B

SUMMARY OF THE INVENTION

Problem to be Solved by the Invention

The Ni-based heat-resistant super alloys described above have an advantage of having a high-temperature compressive strength. But in terms of oxidation resistance, fine scales of nickel oxide are scattered from a die surface upon cooling after heating in the air and this may result in the deterioration in the working environment and the shape deterioration. In order to maximize the effect of being capable of using in the air, oxidation of the die surface and scattering of scales associated therewith become large problems.

It is an object of the present invention to provide a Ni-based alloy for hot die having a high high-temperature compressive strength and a good oxidation resistance and being capable of suppressing the deterioration in the working environment and the shape deterioration in hot forging, and the like, and a hot forging die using the Ni-based alloy for hot die.

Means for Solving the Problem

The present inventors have studied the deterioration in the working environment and the shape deterioration caused by oxidation of the die surface and scattering of scales associated therewith, found a composition having a high high-temperature compressive strength and a good oxidation resistance, and thereby achieved the present invention.

That is, the present invention provides a Ni-based alloy for hot die, comprising W: 7.0 to 15.0%, Mo: 2.5 to 11.0%, Al: 5.0 to 7.5%, Cr: 0.5 to 3.0%, Ta: 0.5 to 7.0%, S: 0.0010% or less, one or two or more selected from rare-earth elements, Y, and Mg in a total amount of 0 to 0.020%, and the balance of Ni with inevitable impurities.

According to the present invention, the Ni-based alloy for hot die can further contain one or two elements selected from Zr and Hf in a total amount of 0.5% or less, in addition to the composition described above.

According to the present invention, the Ni-based alloy for hot die can further contain one or two elements selected from Ti and Nb in a total amount of 3.5% or less in which a total content of Ta, Ti, and Nb is within a range of 1.0 to 7.0%, in addition to the composition described above.

According to the present invention, the Ni-based alloy for hot die can further contain 15.0% or less of Co, in addition to the composition described above.

According to the present invention, the Ni-based alloy for hot die can further contain one or two elements selected from C: 0.25% or less and B: 0.05% or less, in addition to the composition described above.

According to the present invention, 0.2% compressive strength at a test temperature of 1000° C. and a strain rate of $10^{-3}$/sec is preferably 500 MPa or more.

Further preferably, 0.2% compressive strength at a test temperature of 1100° C. and a strain rate of $10^{-3}$/sec is 300 MPa or more.

In addition, the present invention is a hot forging die using the Ni-based alloy for hot die.

Effects of the Invention

The present invention can provide a Ni-based alloy for hot die having a high high-temperature compressive strength and a good oxidation resistance, and can thus provide a hot forging die using this Ni-based alloy. This enables to suppress the deterioration in the working environment and the shape deterioration in hot forging.

MODE FOR CARRYING OUT THE INVENTION

Figure 1:
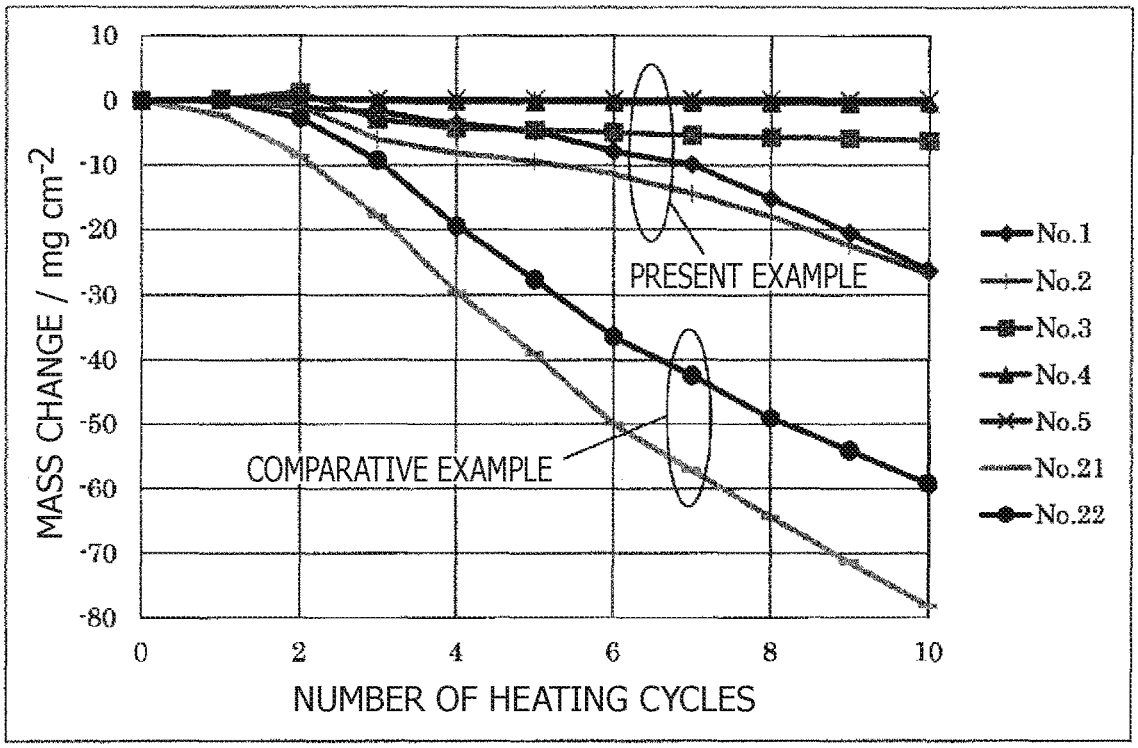
FIG. 1 are graphs showing oxidation resistance in the present examples and the comparative examples under test conditions simulating heating and cooling due to repeated use of a die.
Figure 1:
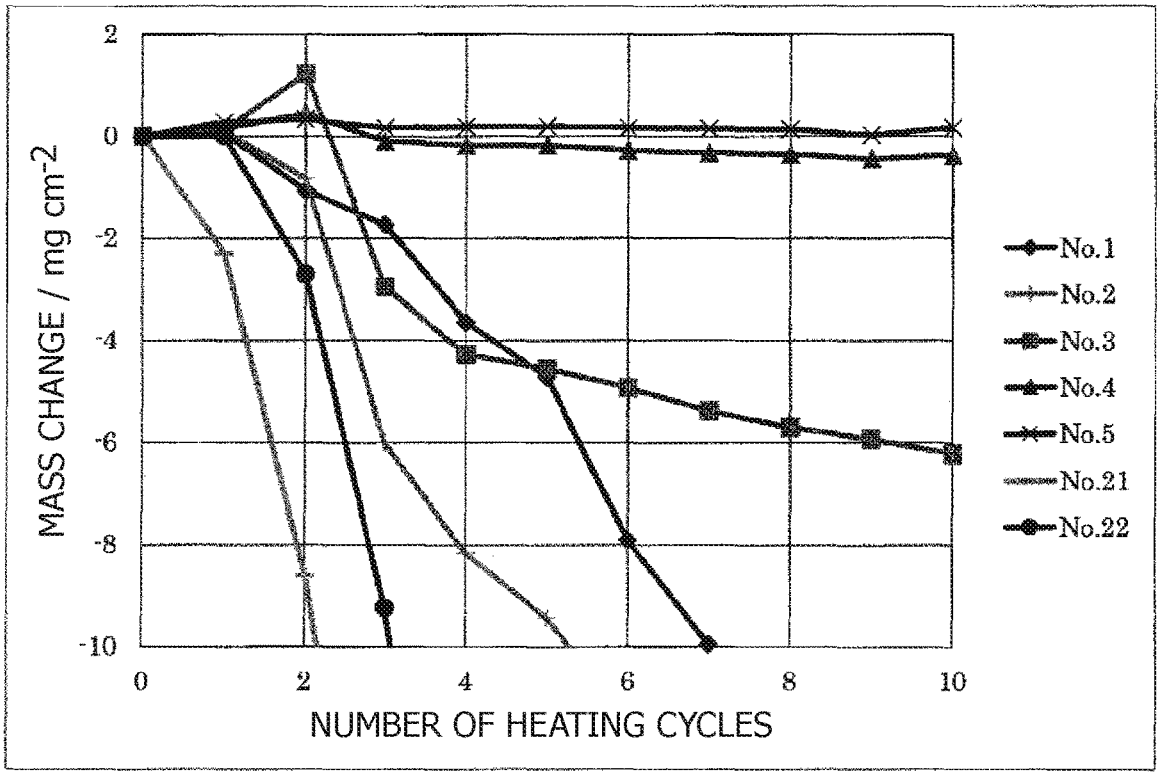

Hereinafter, the Ni-based alloy for hot die of the present invention will be described in detail. The unit for the chemical composition is mass %.

W: 7.0 to 15.0%

W forms a solid solution in an austenitic matrix, and forms a solid solution also in a gamma prime phase (γ' phase) basically composed of $Ni_3Al$ that is a precipitation strengthening phase to enhance the high-temperature strength of the alloy. Meanwhile, W has an effect of reducing the oxidation resistance and an effect of facilitating the precipitation of harmful phases such as the TCP (Topologically Close Packed) phase. From the viewpoint of enhancing the high-temperature strength and suppressing the reduction of the oxidation resistance and the precipitation of harmful phases, the content of W in the Ni-based alloy according to the present invention is 7.0 to 15.0%. In order to more reliably achieve the effect of W, the lower limit is preferably 10.0%, the upper limit is preferably 12.0%, and the upper limit is further preferably 11.0%.

Mo: 2.5 to 11.0%

Mo forms a solid solution in an austenitic matrix and forms a solid solution also in a gamma prime phase basically composed of $Ni_3Al$ that is a precipitation strengthening phase to enhance the high-temperature strength of the alloy. Meanwhile, Mo has an effect of reducing the oxidation resistance. From the viewpoint of enhancing the high-temperature strength and suppressing the reduction of the oxidation resistance, the content of Mo in the Ni-based alloy according to the present invention is 2.5 to 11.0%. In order to suppress the precipitation of harmful phases such as the TCP phase associated with the addition of W and Ta, Ti, and Nb described below, the preferred lower limit of Mo is preferably set by taking into consideration the content of W, Ta, Ti, and Nb. In order to more reliably achieve the effect of Mo, the lower limit is preferably 4.0%, and the lower limit is further preferably 4.5%. The upper limit of Mo is preferably 10.5%, and the upper limit is further preferably 10.2%.

Al: 5.0 to 7.5%

Al has effects of binding to Ni to precipitate a gamma prime phase composed of $Ni_3Al$, enhancing the high-temperature strength of the alloy, producing an alumina film on the surface of the alloy, and imparting the oxidation resistance to the alloy. Meanwhile, an excess content of Al also has an effect of excessively producing eutectic gamma prime phases to reduce the high-temperature strength of the alloy. From the viewpoint of enhancing the oxidation resistance and the high-temperature strength, the content of Al in the Ni-based alloy according to the present invention is 5.0 to 7.5%. In order to more reliably achieve the effect of Al, the lower limit is preferably 5.5%, and the lower limit is further preferably 6.1%. The upper limit of Al is preferably 6.7%, and the upper limit is further preferably 6.5%.

Cr: 0.5 to 3.0%

Cr has effects of promoting the formation of a continuous layer of alumina on the surface of or inside the alloy and increasing the oxidation resistance of the alloy. Thus, 0.5% or more of Cr is required to be contained. Meanwhile, an excess content of Cr also has an effect of facilitating the precipitation of harmful phases such as the TCP phase. Particularly when the elements such as W, Mo, Ta, Ti, and Nb that increase the high-temperature strength of the alloy are contained in a large amount, harmful phases are likely to be precipitated. From the viewpoint of increasing the oxidation resistance and suppressing the precipitation of harmful phases while maintaining the content of elements that increase the high-temperature strength at a high level, the content of Cr according to the present invention is 0.5 to 3.0%. In order to more reliably achieve the effect of Cr, the lower limit is preferably 1.3%, and the upper limit of Cr is preferably 2.0%.

Ta: 0.5 to 7.0%

Ta forms a solid solution by substituting into the Al site in a gamma prime phase composed of $Ni_3Al$, thereby enhancing the high-temperature strength of the alloy. Furthermore, Ta increases the adhesiveness and the oxidation resistance of an oxide film formed on the surface of the alloy, thereby increasing the oxidation resistance of the alloy. In addition, an excess content of Ta has an effect of facilitating the precipitation of harmful phases such as the TCP phase and has also an effect of excessively producing a eutectic gamma prime phase to reduce the high-temperature strength of the alloy. From the viewpoint of enhancing the oxidation resistance and the high-temperature strength and suppressing the precipitation of harmful phases, the content of Ta according to the present invention is 0.5 to 7.0%. In order to more reliably achieve the effect of Ta, the lower limit is preferably 2.5%, and the upper limit of Ta is preferably 6.5%. When Ta is contained with Ti or Nb described below, the upper limit of Ta is preferably 3.5%.

S, Rare-Earth Elements, Y, and Mg

In the Ni-based alloy for hot die according to the present invention, S (sulfur) reduces the adhesion of the oxide film through segregation to the interface between the oxide film formed on the alloy and the alloy as well as inhibition of their chemical bonding. Thus, one or two or more elements selected from rare-earth elements, Y, and Mg that form sulfides with S are preferably contained in a total amount within a range of 0.020% or less, while regulating the upper limit of S to 0.0010% or less (inclusive of 0%). Excess addition of these rare-earth elements, Y, and Mg instead causes a reduction in toughness. The upper limit of the total content of rare-earth elements, Y, and Mg is thus 0.020%. S is a component contained as impurities and remains greater than 0%. When the content of S may become 0.0001% (1 ppm) or more, one or two or more elements selected from rare-earth elements, Y, and Mg may be contained more than the content of S. In the Ni-based alloy of the present invention, rare-earth elements and Y and Mg elements may be 0%.

Among the rare-earth elements, La is preferably used. In addition to the effect of preventing the segregation of S, La also has an effect of suppressing the diffusion in a grain boundary of the oxide film described below. Since these effects are excellent, La may be selected among rare-earth elements. From an economic viewpoint, Mg is preferably used. In addition, an effect of preventing cracks during casting can also be expected for Mg and in the case of selecting any one of rare-earth elements, Y, and Mg, Mg is preferably used. In order to reliably achieve the effect of Mg, 0.0002% or more of Mg may be contained, regardless of the presence or absence of S. Mg is preferably 0.0005% or more, and further preferably 0.0010% or more.

Zr and Hf

The Ni-based alloy for hot die according to the present invention can contain one or two selected from Zr and Hf in a total amount within a range of 0.5% or less (inclusive of 0%). By the segregation of the oxide film into the grain boundary, Zr and Hf suppress the diffusion of metal ions and oxygen at the grain boundary. This suppression of grain boundary diffusion reduces the growth rate of the oxide film and changes the growth mechanism of promoting the spallation of the oxide film, which increases the adhesion between the oxide film and the alloy. That is, these elements have an effect of increasing the oxidation resistance of the alloy by reducing the growth rate of the oxide film and increasing the adhesion of the oxide film as described above. In order to reliably achieve this effect, one or two elements selected from Zr and Hf may be contained in a total amount of 0.01% or more. The lower limit is preferably 0.02%, and the lower limit is further preferably 0.05%. Meanwhile, an excess amount of addition of Zr and Hf causes the excess production of intermetallic compounds with such as Ni and reduces the toughness of the alloy. The upper limit of the total amount of one or two or more selected from elements of Zr and Hf is thus 0.5%. The upper limit is preferably 0.2%, and the upper limit is further preferably 0.15%. Additionally, an effect of preventing cracks during casting can also be expected for Hf, and in the case of selecting either Zr or Hf, Hf is preferably used.

Rare-earth elements and Y also have the effect of suppressing the diffusion in a grain boundary of the oxide film. However, these elements have a higher effect of reducing the toughness than Zr and Hf and the upper limit of the content is low. Thus, as the element to be contained for obtaining this effect, Zr and Hf are more suitable than rare-earth elements or Y. In order to enhance the oxidation resistance and the toughness in a balanced manner, it is particularly preferable that Hf and Mg are simultaneously used.

Ti and Nb

The Ni-based alloy for hot die according to the present invention can contain one or two selected from Ti and Nb in a total amount within a range of 3.5% or less (inclusive of 0%). Ti and Nb form a solid solution like Ta by substituting into the Al site in a gamma prime phase composed of $Ni_3Al$, thereby enhancing the high-temperature strength of the alloy. Ti and Nb are low-cost elements as compared with Ta and advantageous in terms of die cost. Meanwhile, an excess content of Ti and Nb has, like Ta, an effect of facilitating the precipitation of harmful phases such as the TCP phase and has also an effect of excessively producing a eutectic gamma prime phase to reduce the high-temperature strength of the alloy. In addition, Ti and Nb have a lower effect of increasing the high-temperature strength as compared with Ta and have no effect of increasing the oxidation resistance, unlike Ta.

From the above, from the viewpoint of suppressing the reduction in high-temperature strength associated with the precipitation of harmful phases and the excess production of the eutectic gamma prime phase, while limiting the total content of Ta, Ti, and Nb, Ta is desired to be substituted by Ti or Nb that are advantageous in terms of die cost within a range in which the high-temperature strength property and the oxidation resistance are maintained at the same level as the case containing only Ta. According to the present invention, the upper limit of the total content of Ta, Ti, and Nb is 7.0%, and the upper limit of the content of one or two elements selected from Ti and Nb is 3.5%. The upper limit of the total content of Ta, Ti, and Nb is preferably 6.5%, and the upper limit of the content of one or two elements selected from Ti and Nb is preferably 2.7%. From the viewpoint of reliably achieving an effect of enhancing the high-temperature strength, the lower limit of the total content of Ta, Ti, and Nb may be 1.0%, and from the viewpoint of reliably achieve an effect of reducing the die cost, the lower limit of the content of one or two elements selected from Ti and Nb may be 0.5%. The lower limit of the total content of Ta, Ti, and Nb is preferably 3.0%, and the lower limit is further preferably 4.0%. The lower limit of the content of one or two elements selected from Ti and Nb is preferably 1.0%.

From an economic viewpoint, only Ti is particularly preferably used and when the high-temperature strength is particularly important, only Nb is particularly preferably used. When both die cost and high-temperature strength are important, Ti and Nb are particularly preferably simultaneously used.

Co

The Ni-based alloy for hot die according to the present invention can contain Co. Co forms a solid solution in an austenitic matrix to enhance the high-temperature strength of the alloy. Meanwhile, an excess content of Co increases the die cost since Co is an expensive element compared with Ni, and Co has an effect of facilitating the precipitation of harmful phases such as the TCP phase. From the viewpoint of enhancing the high-temperature strength and suppressing the increase in die cost and the precipitation of harmful phases, Co can be contained within a range of 15.0% or less (inclusive of 0%). In order to reliably achieve the effect of Co, the lower limit is preferably 0.5%, and further preferably 2.5%. The upper limit is preferably 13.0%.

C and B

The Ni-based alloy for hot die according to the present invention can contain one or two elements selected from 0.25% or less (inclusive of 0%) of C (carbon) and 0.05% or less (inclusive of 0%) of B (boron). C and B increase the strength of grain boundaries of the alloy and enhance the high-temperature strength and the ductility. Meanwhile, an excess content of C and B causes the formation of a coarse carbide or boride and has an effect of reducing the strength of the alloy. From the viewpoint of enhancing the strength of grain boundaries of the alloy and suppressing the formation of the coarse carbide or boride, the range of the content of C is preferably 0.005 to 0.25% and the range of the content of B is 0.005 to 0.05% according to the present invention. In order to reliably achieve the effect of C, the lower limit is preferably 0.01% and the upper limit is preferably 0.15%. In order to reliably achieve the effect of B, the lower limit is preferably 0.01% and the upper limit is preferably 0.03%.

When the cost-efficiency or the high-temperature strength is important, only C is particularly preferably used, and when the ductility is particularly important, only B is particularly preferably used. When both high-temperature strength and ductility are important, C and B are particularly preferably simultaneously used.

Balance

The elements other than the elements described above in the Ni-based alloy for hot die of the present invention are Ni and inevitable impurities. In the Ni-based alloy for hot die according to the present invention, Ni is the main element for constituting a gamma phase and constitutes also a gamma prime phase together with Al, Ta, Ti, Nb, Mo, and W. As inevitable impurities, P, N, O, Si, Mn, Fe and the like are assumed to be contained. 0.003% or less of each of P, N, and O may be contained and 0.03% or less of each of Si, Mn, and Fe may be contained. In addition to the impurity elements described above, Ca is mentioned as an element that should be particularly limited. The addition of Ca to the composition defined in the present invention significantly reduces the Charpy impact value, and thus, the addition of Ca is to be avoided. The Ni-based alloy of the present invention can also be referred to as the Ni-based heat-resistant alloy.

Hot Forging Die

According to the present invention, a hot forging die using the Ni-based alloy for hot die having the alloy composition described above can be constituted. The hot forging die of the present invention can be obtained by the sintering of alloy powder or casting. Casting having inexpensive manufacturing costs is preferred to sintering of alloy powder. Furthermore, in order to suppress the generation of cracks in the raw material due to stress during solidification, a sand mold or a ceramic mold is preferably used as the casting mold. At least one surface of the die surface or the side surface of the hot forging die of the present invention can be a surface having an application layer of an antioxidant. This more reliably prevents the oxidation of the die surface caused by the contact of oxygen in the air and the base material of the die at a high temperature and scattering of the scale associated therewith, allowing the deterioration in the working environment and the shape deterioration to be prevented. The antioxidant described above is preferably an inorganic material formed by any one or more of nitride, oxide, carbide. This is for forming dense oxygen blocking films by the application layer formed by nitride, oxide, or carbide and for preventing the oxidation of a die base material. The application layer may be a single layer of nitride, oxide, and carbide, or may be a lamination structure formed by combining any two or more of nitride, oxide, and carbide. Furthermore, the application layer may be a mixture of any two or more of nitride, oxide, and carbide.

The hot forging die using the Ni-based alloy for hot die of the present invention described above has a high high-temperature compressive strength and a good oxidation resistance and is capable of preventing oxidation of the die surface caused by the contact of oxygen in the air and base material of the die at a high temperature and scattering of scales associated therewith, and thereby more reliably suppressing the deterioration in the working environment and the shape deterioration.

Method for Manufacturing Forging Product

Representative steps in the case of manufacturing a forging product by using the hot forging die using the Ni-based alloy for hot die will be described.

First, a material for forging is heated to a predetermined forging temperature as a first step. Since the forging temperature differs depending on materials, the temperature is appropriately adjusted. The hot forging die using the Ni-based alloy for hot die has a property of being capable of being used in isothermal forging and hot die forging even at a high temperature in an atmosphere of air, and thus, it is suitable for the hot forging of Ni-based heat-resistant super alloy, Ti alloy, or the like that are known as poor workability materials. Representative forging temperature is within a range of 1000 to 1150° C.

Then, the material for forging heated in the first step is subjected to hot forging by using the pre-heated hot forging die (second step). In the case of the hot die forging or the isothermal forging described above, the hot forging in the second step is preferably closed die forging. As described above, by particularly adjusting the Cr content, the Ni-based alloy for hot die of the present invention can be used in hot forging at a high temperature of 1000° C. or more in the air.

EXAMPLES

The present invention will be described in more detail by way of the following Examples. Ingots of the Ni-based alloy for hot die shown in Table 1 were produced by vacuum melting. The unit is mass %. Each of P, N, and O contained in the ingots described below was 0.003% or less. Each of Si, Mn, and Fe was 0.03% or less. In Table 1, No. 1 to 18 are Ni-based alloys for hot die of "the present examples" and No. 21 to 24 are Ni-based alloys for hot die of "the comparative examples".

TABLE 1

| No. | Mo | W | Al | Cr | Ta | Ti | Nb | Co | Hf | Zr | La | Y | B | C | Mg | S | (mass %) Balance |
|---|---|---|---|---|---|---|---|---|---|---|---|---|---|---|---|---|---|
| 1 | 10.0 | 10.6 | 6.2 | 1.5 | 3.1 | — | — | — | — | — | — | — | — | — | — | 0.0002 | Ni and inevitable impurities |
| 2 | 4.9 | 10.4 | 5.5 | 1.6 | 6.5 | — | — | — | — | — | — | — | — | — | — | 0.0002 | Same as above |
| 3 | 4.9 | 10.3 | 5.5 | 1.6 | 6.5 | — | — | — | 0.12 | — | — | — | — | — | — | 0.0003 | Same as above |
| 4 | 4.9 | 11.0 | 5.5 | 1.6 | 6.3 | — | — | — | — | — | — | — | — | — | 0.017 | 0.0002 | Same as above |
| 5 | 4.9 | 10.6 | 5.5 | 1.6 | 6.4 | — | — | — | 0.17 | — | — | — | — | — | 0.017 | 0.0002 | Same as above |
| 6 | 8.6 | 7.6 | 6.8 | 1.5 | 3.1 | — | — | — | — | — | — | — | — | — | — | 0.0003 | Same as above |
| 7 | 8.6 | 7.6 | 6.8 | 1.5 | 3.1 | — | — | — | 0.12 | — | — | — | — | — | — | 0.0003 | Same as above |
| 8 | 8.6 | 7.6 | 6.8 | 1.5 | 3.1 | — | — | — | — | 0.07 | — | — | — | — | — | 0.0003 | Same as above |
| 9 | 4.9 | 10.4 | 5.7 | 1.6 | 3.3 | 1.5 | — | — | 0.14 | — | — | — | — | — | 0.007 | 0.0002 | Same as above |
| 10 | 4.9 | 10.4 | 5.6 | 1.6 | 3.3 | — | 2.6 | — | 0.15 | — | — | — | — | — | 0.006 | 0.0003 | Same as above |
| 11 | 4.9 | 10.4 | 5.5 | 1.6 | 3.3 | 0.8 | 1.4 | — | 0.15 | — | — | — | — | — | 0.002 | 0.0002 | Same as above |
| 12 | 2.7 | 13.3 | 5.5 | 1.6 | 3.2 | 1.5 | — | — | 0.15 | — | — | — | — | — | 0.006 | 0 0002 | Same as above |
| 13 | 2.6 | 13.4 | 5.4 | 2.2 | 3.2 | 1.5 | — | — | 0.15 | — | — | — | — | — | 0.006 | 0.0002 | Same as above |
| 14 | 2.7 | 13.5 | 5.7 | 1.5 | 3.2 | 1.5 | — | 5.0 | 0.15 | — | — | — | — | — | 0.006 | 0.0002 | Same as above |
| 15 | 2.6 | 13.4 | 5.8 | 1.6 | 3.2 | 1.5 | — | 12.5 | 0.16 | — | — | — | — | — | 0.006 | 0.0002 | Same as above |

TABLE 1-continued

| No. | Mo | W | Al | Cr | Ta | Ti | Nb | Co | Hf | Zr | La | Y | B | C | Mg | S | (mass %) Balance |
|---|---|---|---|---|---|---|---|---|---|---|---|---|---|---|---|---|---|
| 16 | 2.6 | 13.4 | 5.8 | 1.6 | 3.2 | 1.5 | — | 12.5 | 0.16 | — | — | — | 0.017 | — | 0.006 | 0.0002 | Same as above |
| 17 | 2.6 | 13.5 | 5.8 | 1.6 | 3.2 | 1.5 | — | 12.5 | 0.15 | — | — | — | — | 0.1 | 0.006 | 0.0003 | Same as above |
| 18 | 2.6 | 13.5 | 5.8 | 1.6 | 3.2 | 1.5 | — | 12.5 | 0.15 | — | — | — | 0.018 | 0.1 | 0.005 | 0.0003 | Same as above |
| 21 | 10.4 | 10.7 | 6.3 | — | — | — | — | — | — | — | — | — | — | — | — | 0.0002 | Same as above |
| 22 | 10.0 | 10.6 | 6.2 | 1.5 | — | — | — | — | — | — | — | — | — | — | — | 0.0002 | Same as above |
| 23 | 8.6 | 7.6 | 6.7 | 1.5 | 3.1 | — | — | — | — | — | — | 0.04 | — | — | — | 0.0002 | Same as above |
| 24 | 8.6 | 7.6 | 6.7 | 1.5 | 3.1 | — | — | — | — | — | 0.07 | — | — | — | — | 0.0004 | Same as above |

* The symbol "—" means no addition.

Cubes having a side of 10 mm were cut out from each of the ingots and their surfaces were polished by the one equivalent to #1000 to produce oxidation resistance test specimens and then the oxidation resistance was evaluated. In the oxidation resistance test, a test simulating repeated use of the die for hot forging in the air was performed.

By using test specimens of the alloys of No. 1 to 18 of the present examples and the alloys of No. 21 to 24 of the comparative examples, a heating test was performed in which test specimens were loaded into a furnace heated to 1100° C. in a state disposed on a ceramic container made of $SiO_2$ and $Al_2O_3$, held at 1100° C. for 3 hours, then taken out from the furnace, and air-cooled. In order to evaluate the oxidation resistance to the repeated use, the heating test was repeated 10 times by cooling and then reloading.

For each of the test specimens, the surface area and the mass of the test specimens were measured before the first heating test, and each mass of the test specimens that were cooled to room temperature after the first to 10th heating tests and then scales on their surfaces were removed by a blower and were measured. The mass change per unit surface area of the test specimens after each test was calculated by subtracting the mass measured before the first test from the mass measured after each test, and then dividing the value by the surface area measured before the first test. The higher the absolute value of the value of mass change is, the higher the scattering amount of scales per unit area is. Each mass change after the number of repetitions was determined as follows.

Mass change=(mass after test−mass before the first test)/surface area before the first test The mass change per unit surface area of the test specimens calculated after each heating test is shown in Table 2. The unit of the mass change is mg/cm$^2$. The relationship between the number of heating tests and the mass change in No. 1 to 5 of the present examples and No. 21 and No. 22 of the comparative examples is shown in FIG. 1(*a*) and an enlarged view of the vertical axis (mass change) of FIG. 1(*a*) is shown in FIG. 1(*b*).

As shown in FIG. 1(*a*), the generation of scales (scattering) is suppressed and the absolute value of the value of mass change is low in the alloys of No. 1 to 5 of the present examples, as compared with that in the alloys of No. 21 and 22 of the comparative example, and the alloys of No. 1 to 5 are found to have a good oxidation resistance against repeated use. Among them, scattering of scales is particularly suppressed in No. 3 in which Hf was added in addition to Cr and Ta and in No. 4 in which Mg was added in addition to Cr and Ta, as compared with No. 1 and 2 in which only Cr and Ta were added, and No. 3 and No. 4 are found to be particularly excellent in oxidation resistance against repeated use.

As shown in FIG. 1(*b*), No. 5 in which both Hf and Mg were added together is found to be further excellent in oxidation resistance against repeated use, as compared with No. 3 and No. 4 described above.

As shown in Table 2, the generation of scales (scattering) is suppressed and the absolute value of the value of mass change is low in the alloys of 6 to 18 of the present examples, as compared with that in the alloys of No. 21 and 22 of the comparative example, and 6 to 18 are found to have a good oxidation resistance against repeated use.

TABLE 2

| | Mass change after each heating test (mg/cm$^2$) | | | | | | | | | |
|---|---|---|---|---|---|---|---|---|---|---|
| No. | 1 | 2 | 3 | 4 | 5 | 6 | 7 | 8 | 9 | 10 |
| 1 | 0.1 | −1.1 | −1.7 | −3.7 | −4.7 | −7.9 | −10.0 | −15.2 | −20.6 | −26.3 |
| 2 | 0.1 | −0.8 | −6.0 | −8.2 | −9.4 | −11.4 | −14.4 | −18.1 | −22.5 | −26.8 |
| 3 | 0.1 | 1.2 | −3.0 | −4.3 | −4.6 | −4.9 | −5.4 | −5.7 | −5.9 | −6.2 |
| 4 | 0.2 | 0.5 | −0.1 | −0.2 | −0.2 | −0.3 | −0.3 | −0.4 | −0.5 | −0.4 |
| 5 | 0.3 | 0.3 | 0.2 | 0.2 | 0.2 | 0.2 | 0.1 | 0.1 | 0.0 | 0.2 |
| 6 | −0.1 | −4.0 | −5.6 | −6.2 | −9.1 | −11.8 | −16.3 | −21.1 | −26.5 | −29.4 |
| 7 | 0.0 | −1.9 | −5.9 | −7.3 | −7.5 | −7.8 | −8.0 | −8.1 | −8.1 | −8.2 |
| 8 | 0.1 | −1.7 | −3.3 | −3.6 | −3.7 | −3.9 | −4.0 | −4.0 | −4.0 | −4.1 |
| 9 | 0.3 | 0.3 | 0.3 | 0.2 | 0.2 | 0.2 | 0.1 | 0.2 | 0.2 | 0.2 |
| 10 | 0.6 | 0.4 | 0.3 | 0.2 | 0.2 | 0.2 | 0.2 | 0.1 | 0.1 | 0.2 |
| 11 | 0.5 | 0.5 | 0.4 | 0.4 | 0.4 | 0.4 | 0.4 | 0.3 | 0.3 | 0.4 |
| 12 | 0.8 | 0.8 | 0.9 | 0.8 | 0.8 | 0.9 | 0.8 | 0.8 | 0.7 | 0.9 |
| 13 | 0.4 | 0.4 | 0.4 | 0.4 | 0.4 | 0.5 | 0.5 | 0.5 | 0.4 | 0.5 |

TABLE 2-continued

| No. | Mass change after each heating test (mg/cm$^2$) | | | | | | | | | |
|---|---|---|---|---|---|---|---|---|---|---|
| | 1 | 2 | 3 | 4 | 5 | 6 | 7 | 8 | 9 | 10 |
| 14 | 0.7 | 0.8 | 0.7 | 0.8 | 0.7 | 0.8 | 0.8 | 0.8 | 0.7 | 0.8 |
| 15 | 0.4 | 0.5 | 0.5 | 0.6 | 0.4 | 0.6 | 0.5 | 0.5 | 0.4 | 0.6 |
| 16 | 0.5 | 0.9 | 1.0 | 1.2 | 1.1 | 1.4 | 1.4 | 1.5 | 1.5 | 1.7 |
| 17 | 0.3 | 0.4 | 0.4 | 0.4 | 0.3 | 0.5 | 0.4 | 0.5 | 0.3 | 0.5 |
| 18 | 0.8 | 1.2 | 1.6 | 1.6 | 1.6 | 1.8 | 1.9 | 2.0 | 1.9 | 2.2 |
| 21 | −2.3 | −8.6 | −18.0 | −29.5 | −39.0 | −50.0 | −57.1 | −64.3 | −71.4 | −78.2 |
| 22 | 0.0 | −2.7 | −9.2 | −19.5 | −27.6 | −36.4 | −42.4 | −49.1 | −54.0 | −59.2 |
| 23 | 0.2 | 0.1 | 0.0 | −0.1 | −0.2 | −0.3 | −0.6 | −0.6 | −0.7 | −0.8 |
| 24 | 0.3 | 0.4 | 0.4 | 0.4 | 0.5 | 0.5 | 0.4 | 0.5 | 0.5 | 0.5 |

Then, U-notch test specimens of 10 mm×10 mm×55 mm having a notch depth of 2 mm in accordance with ASTM E23 were produced from each of the ingots of No. 2 to 8 of the present examples and No. 23 and 24 of the comparative examples in Table 1. By using these test specimens, the Charpy impact test was conducted at room temperature in accordance with ASTM E23 to determine the impact value. This impact test is to test whether cracks of the die are generated due to thermal stress generated upon heating and cooling of the die when the die is used as the die for hot forging. When the Charpy impact value is 20 J/cm$^2$ or more, it can be said that cracks are less likely to be generated.

Figure 2:
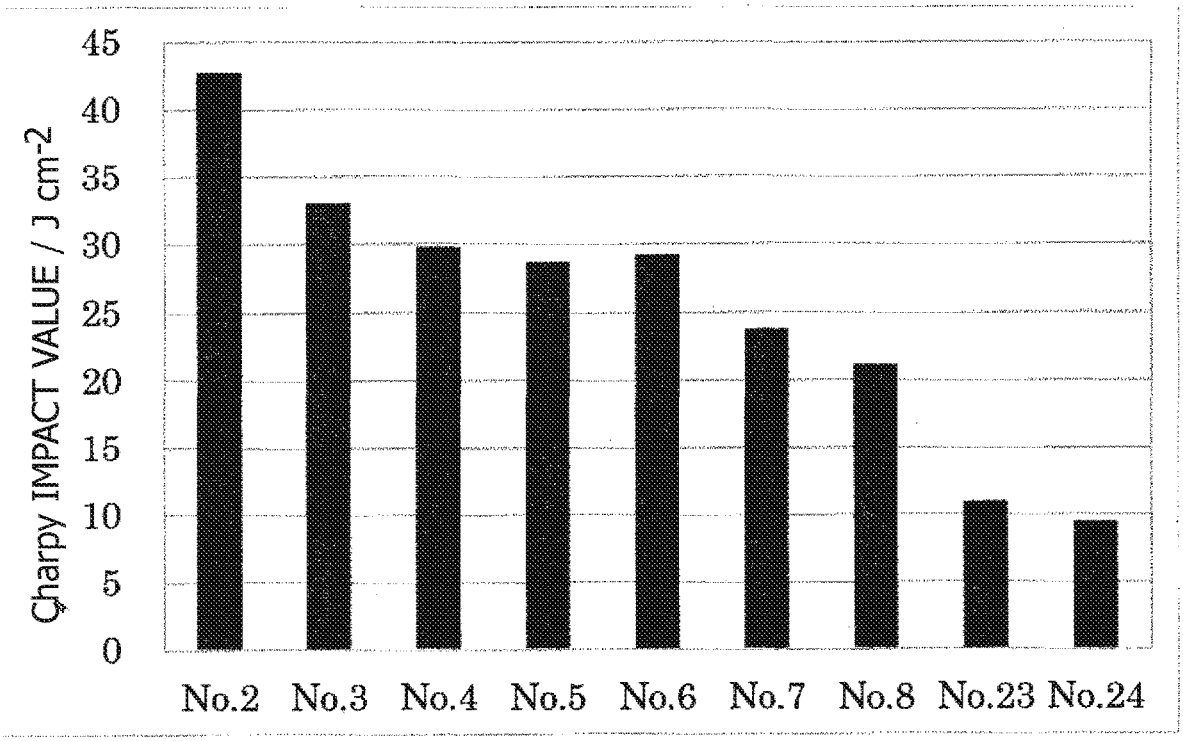
FIG. 2 is a graph showing Charpy impact values of the present examples and the comparative examples.

Charpy impact values at room temperature of No. 2 to 8 of the present examples and No. 23 and 24 of the comparative examples are shown in Table 3. These Charpy impact values are also illustrated in FIG. 2. As shown in FIG. 2, the alloys of No. 2 to 8 of the present invention had higher Charpy impact values as compared with the alloys of No. 23 and 24 of the comparative examples, and it can be found that the die is less likely to be cracked.

Seeing the comparison between No. 7 and 8 of the present examples and No. 23 and 24 of the comparative examples, the reason why Charpy impact values of the comparative examples are low is excess addition of rare-earth elements (La) and Y that have a high effect of reducing the toughness.

TABLE 3

| No. | Charpy impact value (J/cm$^2$) |
|---|---|
| 2 | 42.8 |
| 3 | 33.1 |
| 4 | 29.8 |
| 5 | 28.7 |
| 6 | 29.2 |
| 7 | 23.8 |
| 8 | 21.2 |
| 23 | 11.0 |
| 24 | 9.5 |

Then, raw materials for collecting test specimens having a diameter of 8 mm and a height of 12 mm were cut out from each of the ingots of No. 1 to 18 of the present examples and No. 21 to 24 in Table 1 and their surfaces were polished by the one equivalent to #1000 to produce compression test specimens.

By using these compression test specimens, a compression test was performed. Two conditions of 1000° C. and 1100° C. were set as the compression test temperature. The test temperature of 1000° C. is mainly used to verify application to "hot die forging" and the test temperature of 1100° C. is mainly used to verify application to "isothermal forging". The compression test was performed under the test conditions of the test temperature of 1000° C. and 1100° C., the strain rate of $10^{-3}$/sec, and the compression rate of 10%. The 0.2% compressive strength was derived from stress-strain curves obtained by the compression test and the high-temperature compressive strength was evaluated. This compression test is to test whether the die has enough compressive strength even under high temperature as the die for hot forging, and when the compressive strength is 300 MPa or more at the test temperature of 1100° C. at which the isothermal forging is assumed, it can be said that the die has sufficient strength. The compressive strength is preferably 350 MPa or more, and further preferably 380 MPa or more. When the compressive strength is 500 MPa or more at the test temperature of 1000° C. at which the hot die forging is assumed, it can be said that the die has sufficient strength. The compressive strength is preferably 550 MPa or more, and further preferably 600 MPa or more.

The 0.2% compressive strength of the test specimens of No. 1 to 18 of the present examples and No. 21 to 24 of the comparative examples at each test temperature is shown in Table 4. It can be found from Table 4 that the compressive strength of No. 1 of the present example at 1000° C. and at a strain rate of $10^{-3}$/sec is 500 MPa or more. In addition, the compressive strength of No. 1 to 18 of the present examples at 1000° C. and at a strain rate of $10^{-3}$/sec is 300 MPa or more, and thus, it can be found that any of the Ni-based alloys for hot die of the present invention have a high high-temperature compressive strength. In particular, it can be found from No. 5 in which neither Ti nor Nb is contained and the content of Ta is high and No. 9 to 11 in which Ti or Nb is contained and the content of Ta is relatively low that sufficient high-temperature strength can be maintained, even when Ta is substituted with Ti or Nb, which are advantageous in terms of die cost, within a range of the present invention. In addition, it can be found from No. 12 in which no Co is contained and No. 14 and No. 15 having compositions obtained by adding Co to No. 12 that the high-temperature strength can be enhanced by containing Co.

TABLE 4

| No. | Compression test value (MPa) | |
|---|---|---|
| | 1000° C. | 1100° C. |
| 1 | 638 | 489 |
| 2 | — | 406 |
| 3 | — | 332 |
| 4 | — | 396 |
| 5 | — | 400 |
| 6 | — | 390 |
| 7 | — | 421 |
| 8 | — | 406 |
| 9 | — | 436 |

TABLE 4-continued

| No. | Compression test value (MPa) 1000° C. | 1100° C. |
|---|---|---|
| 10 | — | 375 |
| 11 | — | 374 |
| 12 | — | 418 |
| 13 | — | 404 |
| 14 | — | 423 |
| 15 | — | 449 |
| 16 | — | 456 |
| 17 | — | 424 |
| 18 | — | 374 |
| 21 | 504 | 390 |
| 22 | 684 | 376 |
| 23 | — | 391 |
| 24 | — | 384 |

* The symbol "—" means not performed.

Then, tensile test specimens having a diameter of 12 mm and a height of about 100 mm were produced from each of the ingots of No. 15 to 18 of the present examples in Table 1 and tensile test was performed at 1100° C. in accordance with ASTM E21 to measure values of the reduction of area, thereby evaluating the ductility of the alloys at the operating temperature when the die was applied to "isothermal forging". The values of the reduction of area of the test specimens of No. 15 to 18 in the tensile test at 1100° C. are shown in Table 5. It can be found from Table 5 that the values of the reduction of area are higher and the ductility is higher in No. 16 to 18 having compositions obtained by adding C or B to No. 15 than No. 15 in which neither C nor B is contained.

TABLE 5

| No. | Value of reduction of area (%) |
|---|---|
| 15 | 0.3 |
| 16 | 3.0 |
| 17 | 1.6 |
| 18 | 3.2 |

From the results described above, the Ni-based alloy for hot die of the present invention has sufficient oxidation resistance and a high compressive strength at a high temperature at the same time when used in hot forging in the air, and it can be found that that cracks are less likely to be generated in the die. Since spallation of scales was able to be particularly significantly suppressed, the deterioration in the working environment and the shape deterioration can be suppressed.

The Ni-based alloy for hot die of the present invention described above can be processed into a predetermined shape to make a hot forging die. The hot forging die made of Ni-based alloy for hot die of the present invention and having properties described above is suitable for hot die forging and isothermal forging in the air.

The invention claimed is:

1. A hot forging die made of a Ni-based alloy, comprising, in mass %, W: 7.0 to 15.0%, Mo: 2.5 to 11.0%, Al: 5.0 to 7.5%, Cr: 0.5 to 3.0%, Ta: 0.5 to 7.0%, S: 0.0010% or less, one or two or more selected from rare-earth elements, Y, and Mg in a total amount of 0 to 0.020%, and the balance of Ni with inevitable impurities.

2. The hot forging die according to claim 1, wherein the Ni-based alloy further comprises, in mass %, one or two elements selected from Zr and Hf in a total amount of 0.5% or less.

3. The hot forging die according to claim 1, wherein the Ni-based alloy further comprises, in mass %, one or two elements selected from Ti and Nb in a total amount of 3.5% or less, wherein a total content of Ta, Ti, and Nb is 1.0 to 7.0%.

4. The hot forging die according to claim 1, wherein the Ni-based alloy further comprises, in mass %, 15.0% or less of Co.

5. The hot forging die according to claim 1, wherein the Ni-based alloy further comprises, in mass %, one or two elements selected from C: 0.25% or less and B: 0.05% or less.

6. The hot forging die according to claim 1, wherein the Ni-based alloy has 0.2% compressive strength at a test temperature of 1000° C. and a strain rate of $10^{-3}$/sec is 500 MPa or more.

7. The hot forging die according to claim 1, wherein the Ni-based alloy has 0.2% compressive strength at a test temperature of 1100° C. and a strain rate of $10^{-3}$/sec is 300 MPa or more.

* * * * *